US008893330B2

(12) United States Patent
Sion et al.

(10) Patent No.: US 8,893,330 B2
(45) Date of Patent: Nov. 25, 2014

(54) FOLDABLE LIGHTWEIGHT STRETCHER

(75) Inventors: Dan Sion, Yavne (IL); Alazar C. Yinbal, Los Angeles, CA (US)

(73) Assignee: Telestretch Ltd, Yavne (IL)

( * ) Notice: Subject to any disclaimer, the term of this patent is extended or adjusted under 35 U.S.C. 154(b) by 455 days.

(21) Appl. No.: 13/320,070

(22) PCT Filed: May 11, 2010

(86) PCT No.: PCT/IL2010/000376

§ 371 (c)(1),
(2), (4) Date: Nov. 11, 2011

(87) PCT Pub. No.: WO2010/131247

PCT Pub. Date: Nov. 18, 2010

(65) Prior Publication Data

US 2012/0054970 A1 Mar. 8, 2012

Related U.S. Application Data

(60) Provisional application No. 61/177,281, filed on May 12, 2009.

(51) Int. Cl.
*A61G 1/013* (2006.01)

(52) U.S. Cl.
USPC ..... 5/625; 5/627

(58) Field of Classification Search
USPC ..... 5/625–628
See application file for complete search history.

(56) References Cited

U.S. PATENT DOCUMENTS

| | | | | | |
|---|---|---|---|---|---|
| 1,151,495 | A | * | 8/1915 | Menten | 5/122 |
| 1,270,107 | A | * | 6/1918 | Boardman | 5/627 |
| 1,693,537 | A | * | 11/1928 | Adkins et al. | 5/114 |
| 3,110,912 | A | | 11/1963 | Propst | |
| 3,417,412 | A | | 12/1968 | Andrews | |
| 3,813,712 | A | * | 6/1974 | Bonnin | 5/625 |
| 4,685,161 | A | | 8/1987 | Zalman | |
| 4,799,274 | A | | 1/1989 | Dommerud | |
| 4,943,041 | A | | 7/1990 | Romein | |
| 5,283,919 | A | | 2/1994 | Grant | |
| 5,598,592 | A | | 2/1997 | Castellani | |
| 6,079,072 | A | | 6/2000 | Katsiri | |
| 2004/0010852 | A1 | | 1/2004 | Bourgraf | |

OTHER PUBLICATIONS

International Search Report Date Sep. 20, 2010 for corresponding International Application PCT/IL2010/000376.

* cited by examiner

*Primary Examiner* — Fredrick Conley
(74) *Attorney, Agent, or Firm* — The Law Office of Michael E. Kondoudis

(57) ABSTRACT

A foldable stretcher for transporting an object. The stretcher comprising: a plurality of substantially plane members pivotally connected with each other in series by means of hinges there between; handles pivotally connected to outermost of the plane members; and, at least two pluralities of props. The stretcher further comprises at least two pairs of sufficiently stiff wires. Each pair of the wires arranged along a corresponding long side of the stretcher; each the wire is mechanically connected to the stretcher at least two connection points; the handles adapted for actuating a tautening of at least one of the wires of each pair of wires by fixation of the handles when the stretcher is in the unfolded position.

19 Claims, 5 Drawing Sheets

FOLDABLE LIGHTWEIGHT STRETCHER

FIELD OF THE INVENTION

The present invention relates to a foldable stretcher, and more particularly, a foldable, lightweight stretcher which is sufficiently compact when folded, and sufficiently strong and stable when unfolded.

BACKGROUND OF THE INVENTION

Stretchers are used for evacuating wounded or ill persons to a safe area or to an ambulance, and then to hospital if needed. It has long been clear that a stretcher needs to be lightweight, strong, and foldable, as well as very quickly and easily erectable. To meet this need, stretchers having multiple fold lines have been developed. Such stretchers are readily transported in the folded state, and are sufficiently compact to allow a medic or any rescue crewmember to carry a folded stretcher by hand or on the back.

In U.S. Pat. No. 4,799,274 Dommerud discloses a stretcher described as foldable. However only the width dimension can be reduced, and after "folding" the device remains about 2 meters long.

U.S. Pat. No. 5,283,919 discloses a stretcher which can be folded for storage along one central axis. The design described has too many features to be sufficiently lightweight for convenient carrying by one person, and the width cannot be reduced by folding.

U.S. Patent Application No. 2004/0010852 discloses a tactical stretcher used to transport accident victims, in particular, to stretcher type devices used to transport victims who have been exposed to hazardous materials is disclosed. The tactical stretcher comprises a foldable tubular frame having spreader assemblies attached thereto for securing the stretcher in a folded or unfolded position, the folded position having reduced width.

SUMMARY OF THE INVENTION

It is hence one object of the invention to disclose a foldable lightweight stretcher for transporting an object. The stretcher comprises a plurality of substantially plane members pivotally connected with each other in series by means of hinges placed therebetween. The plurality of plane members is reversibly configurable into an unfolded operative position and a folded transport position. The invention further comprises handles pivotally connected to outermost of the plane members. The invention further comprises at least two pluralities of props. The props adapted to support the plane members placed on a horizontal surface in the unfolded position. The props are perpendicular to the plane members placed on a horizontal surface in the unfolded position. Each plurality of props is uniformly spaced along a corresponding long side of the stretcher. Each plurality of props pivotally connected to the hinges in an individual manner.

It is a core purpose of the invention to provide a foldable stretcher which further comprises at least two pairs of sufficiently stiff wires. Each pair of the wires arranged along a corresponding long side of the stretcher. Each wire is mechanically connected to the stretcher at least two connection points. The handles adapted for actuating the tautening of at least one of the wires of each pair of wires by locking the handles when they are parallel to the plane members of the stretcher in the unfolded position. The tautening of the wires triangularly fixates the hinged props in a supporting position and a first wire and a second wire of each pair of wires fixates even and odd props, respectively. The special construction of the stretcher allows its weight to be much lighter than the standard stretchers known in the prior art.

It is a core purpose of the invention to provide a foldable stretcher further comprises two sufficiently stiff wires. Each wire is arranged along each corresponding long side of the stretcher. Each wire is mechanically connected to the stretcher at least two connection points. The handles are adapted for actuating a tautening of the wires by locking the handles when they are parallel to the plane members of the stretcher in the unfolded position. The tautening of the wires triangularly fixates the hinged props in a supporting position.

Another object of the invention is to disclose a foldable stretcher adapted in the folded position for transporting on a user's back, storage, in a baggage compartment of a vehicle and any combination thereof.

Another object of the invention is to disclose a foldable stretcher for transporting an object is selected from the group consisting of a patient, an individual of limited capability, an disabled person, an injured person, a victim of emergency, an animal, an unanimated object or any combination thereof.

Another object of the invention is to disclose the plane members which are made of a material selected from the group consisting of a metal, a polymeric material, a composite material, wood and combination thereof.

Another object of the invention is to disclose plane members which are configured into a shape selected from the group consisting of a grate-like shape, a honeycomb-like shape, a perforated shape and any combination thereof.

Another object of the invention is to disclose the foldable stretcher, configured for using as a footbridge.

Another object of the invention is to disclose the foldable stretcher, configured for using as a bed.

Another object of the invention is to disclose the foldable stretcher, configured for fixation of the object to the stretcher by means of tying.

Another object of the invention is to disclose the foldable stretcher at least partially transparent to X-rays and electromagnetic fields.

Another object of the invention is to disclose a method of transporting an object, the method comprising the steps of:

(a) providing a foldable stretcher for transporting an object in unfolded position. The stretcher comprises a plurality of substantially plane members pivotally connected with each other in series by means of hinges placed therebetween. The plurality of plane members is reversibly configurable into an unfolded operative position and a folded transport position. The invention further comprises handles pivotally connected to outermost of the plane members. The invention further comprises at least two pluralities of props. The props adapted to support the plane members placed on a horizontal surface in the unfolded position. The props are perpendicular to the plane members placed on a horizontal surface in the unfolded position. Each plurality of props is uniformly spaced along a corresponding long side of the stretcher. Each plurality of props pivotally connected to the hinges in an individual manner. The foldable stretcher further comprises at least two pairs of sufficiently stiff wires. Each pair of the wires arranged along a corresponding long side of the stretcher. Each wire is mechanically connected to the stretcher at at least two connection points. The handles adapted for actuating the tautening of at least one of the wires of each pair of wires by locking the handles when they are parallel to the plane members of the stretcher in the unfolded position. The tautening of the wires triangularly fixates the hinged props in a supporting position and a first wire and a second wire of each pair of wires fixates even and odd props, respectively.

(b) unfolding the stretcher into operative position at the horizontal surface;

(c) placing an object on the stretcher;

(d) tautening the wires of the stretcher by holding the handles and lifting the stretcher;

(e) transporting the object to a location of interest on the stretcher;

(f) taking down the object from the stretcher; and (g) folding the stretcher.

Another object of the invention is to disclose a method of providing the foldable stretcher in a folded position. The folded position is adapted for transporting on a user's back, storage, in a baggage compartment of a vehicle and any combination thereof.

Another object of the invention is to disclose a method of transporting an object, the method comprising the steps of:

(h) providing a foldable stretcher for transporting an object in unfolded position. The stretcher comprises a plurality of substantially plane members pivotally connected with each other in series by means of hinges placed therebetween. The plurality of plane members is reversibly configurable into an unfolded operative position and a folded transport position. The invention further comprises handles pivotally connected to outermost of the plane members. The invention further comprises at least two pluralities of props. The props adapted to support the plane members placed on a horizontal surface in the unfolded position. The props are perpendicular to the plane members placed on a horizontal surface in the unfolded position. Each plurality of props is uniformly spaced along a corresponding long side of the stretcher. Each plurality of props pivotally connected to the hinges in an individual manner. The foldable stretcher further comprises two sufficiently stiff wires. Each wire is arranged along each corresponding long side of the stretcher. Each wire is mechanically connected to the stretcher at least two connection points. The handles are adapted for actuating a tautening of the wires by locking the handles when they are parallel to the plane members of the stretcher in the unfolded position. The tautening of the wires triangularly fixates the hinged props in a supporting position.

(i) unfolding the stretcher into operative position at the horizontal surface;

(j) placing an object on the stretcher;

(k) tautening the wires of the stretcher by holding the handles and lifting the stretcher;

(l) transporting the object to a location of interest on the stretcher;

(m) taking down the object from the stretcher; and (n) folding the stretcher.

Another object of the invention is to disclose a method of providing the foldable stretcher in a folded position. The folded position is adapted for transporting on a user's back, storage, in a baggage compartment of a vehicle and any combination thereof.

Another object of the invention is to disclose a method of transporting the object is selected from the group consisting of a patient, an individual of limited capability, a disabled person, an injured person, a victim of emergency, an animal, an unanimated object or any combination thereof.

Another object of the invention is to disclose a method of providing the foldable stretcher which comprises plane members which are made of a material selected from the group consisting of a metal, a polymeric material, a composite material, wood and combination thereof.

Another object of the invention is to disclose a method of providing the foldable stretcher which comprises plane members which are configured into a shape selected from the group consisting of a grate-like shape, a honeycomb-like shape, a perforated shape and any combination thereof.

Another object of the invention is to disclose a method of providing the foldable stretcher which is configured for using as a footbridge.

Another object of the invention is to disclose a method of providing the foldable stretcher which is configured for using as a bed.

Another object of the invention is to disclose a method of providing the foldable stretcher which is configured for fixation of the object to the stretcher by means of tying.

Another object of the invention is to disclose a method of providing the foldable stretcher which is at least partially transparent to X-rays and electro-magnetic fields.

BRIEF DESCRIPTION OF THE DRAWINGS

In order to understand the invention and to see how it may be implemented in practice, a plurality of embodiments is adapted to now be described, by way of non-limiting example only, with reference to the accompanying drawings, in which.

DETAILED DESCRIPTION OF THE INVENTION

The following description is provided, alongside all chapters of the present invention, so as to enable any person skilled in the art to make use of the invention and sets forth the best modes contemplated by the inventor of carrying out this invention. Various modifications, however, are adapted to remain apparent to those skilled in the art, since the generic principles of the present invention have been defined specifically to provide.

Figure 1:
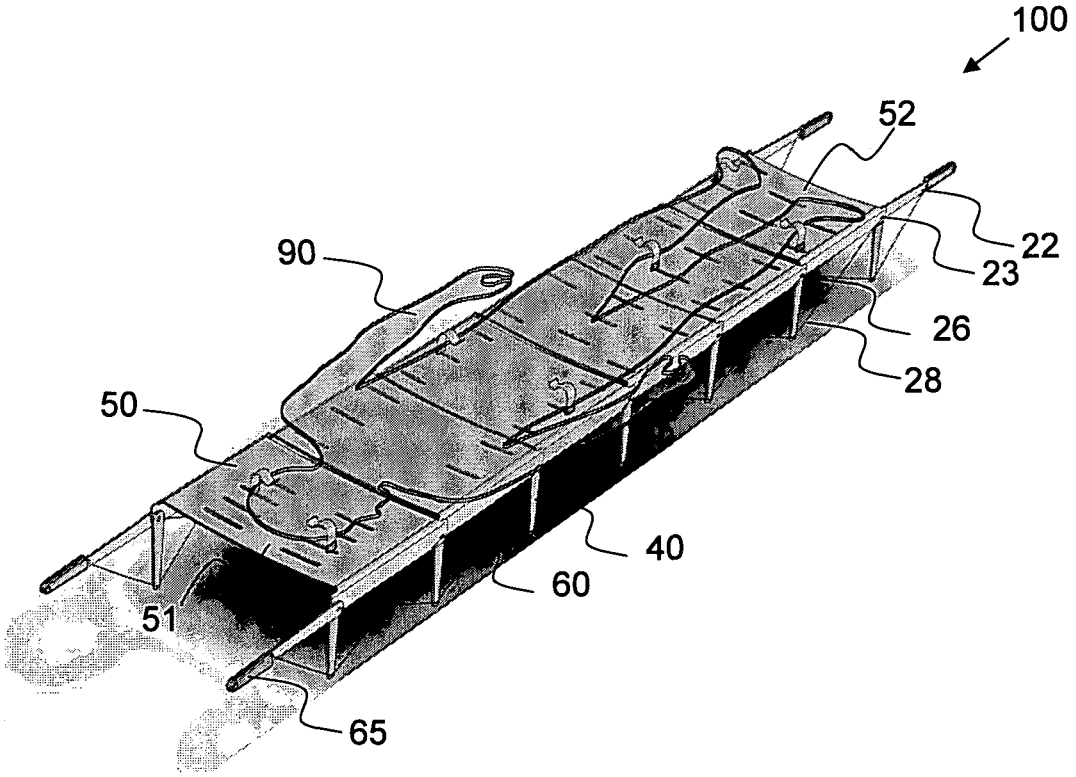
FIG. 1 is a schematic illustration of a foldable stretcher 100 in an unfolded position.

FIG. 1 schematically illustrates an embodiment of a foldable stretcher 100 for transporting a person 90. The stretcher 100 is in an unfolded operative position. The stretcher 100 comprises 6 plane members 50 pivotally connected with each other in series by means of hinges 60 placed therebetween. The plane members 50 are reversibly configurable into an unfolded operative position, as presented in FIG. 1. The plane members 50 of the stretcher 100 are characterized by a descending width. The plane member 51 in the left terminate of the stretcher 100 is the widest, and plane member 52 in the right terminate of the stretcher 100 the narrowest.

The stretcher 100 is further comprises handles 65 pivotally connected to outermost plane members 50. The stretcher 100 is further comprises two pluralities of props 40. The props 40 are uniformly spaced along a corresponding long side of the stretcher 100 perimeter, 7 props 40 in each side of the stretcher 100. The props 40 are adapted to support the plane members 50 placed on a horizontal surface in an unfolded position of the stretcher 100. The props 40 are perpendicular to the plane members 50 placed on a horizontal surface in the unfolded position. The props 40 are pivotally connected to the hinges 60 in an individual manner. The stretcher 100 is further comprises two pairs of sufficiently stiff wires. Each pair of the wires has two wires: a first wire 26 and a second wire 28 arranged along a corresponding long side of the stretcher 100. For example, wire 26 mechanically connected to the stretcher 100 in a connection point 22, and wire 28 mechanically connected to the stretcher 100 in a connection point 23. When the stretcher 100 is in the unfolded position with a person on it, and carried by the handles 65, the handles 65 and the weight of the person 90 is activated on the plane members 50 and hinges 60 tauten the wires 26 and 28. The tautening of the wires 26 and 28 triangularly fixates the hinged props in a supporting position. Wire 26 fixates the odd props 40, and wire 28 fixates the even props 40. Wire 26 is mechanically connected to both handles 65, and wire 28 is mechanically connected to the first and the last hinges 60 of the stretcher 100.

Figure 2:
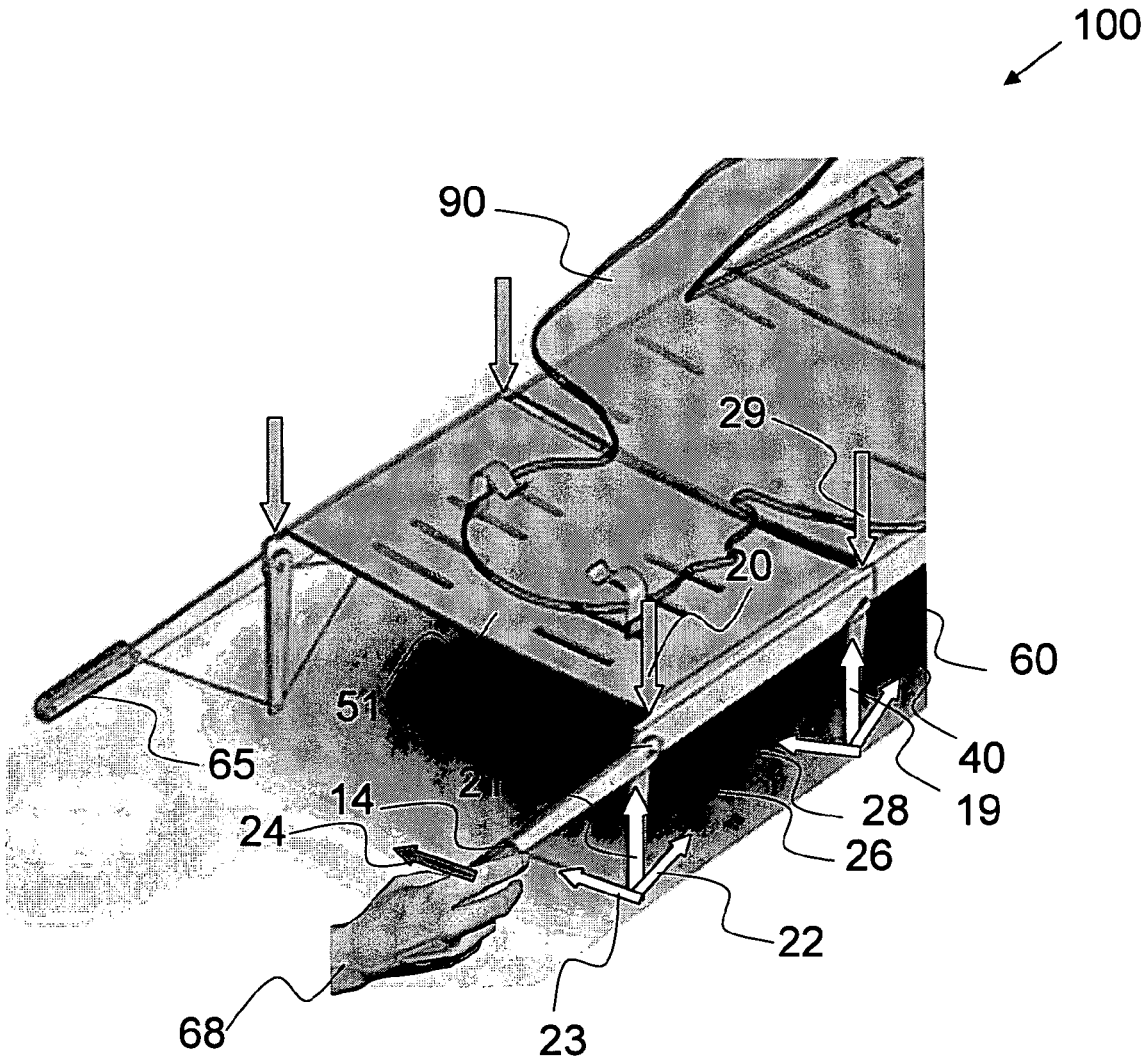
FIG. 2 is a schematic illustration of the fixation mechanism of the foldable stretcher 100 in an unfolded position.

FIG. 2 schematically illustrates the same embodiment of the foldable stretcher 100. This figure illustrates the forces activated on the stretcher 100 and its components while the stretcher 100 is in an unfolded position; a person 90 is upon the stretcher; and the stretcher is lifted from its both sides by handles 65, by two people whose hands 68 lift the stretcher 100. The mass of the person 90 actuates a weight forces (for example: 20 and 29) and on the plane members 51, and on the hinges 60. The weight force 20 is cancelled by the force 21. The force 21 is the total vector of forces 22 and 23 which are created by the tautened wire 26. The force 21 is activated on the odd props 40 and on the odd hinges 60. The tautening of wire 26 is created by a human force 24 activated by the hands 68 for holding the stretcher 100 lifted, and more particularly in the connection point 14 of wire 26 and handle 60. The force 21 is equally distributed in the odd props 40, and triangularly fixates them. This fixation is preventing the stretcher 100 from bending. The role of wire 28 is to triangularly fixate the even props 40 by tautening when the weight force 29 is activated, and preventing the stretcher 100 from bending. The prevention of bending of stretcher 100 by wire 28 is performed by a cancellation force 19 which is activated on the even props 40 and even hinges 60 and equally distributed in the stretcher 100. The force 19 is the total vector of forces 18 and 17 which are created by the tautened wire 28. The force 19 cancels the force 29.

Figure 3:
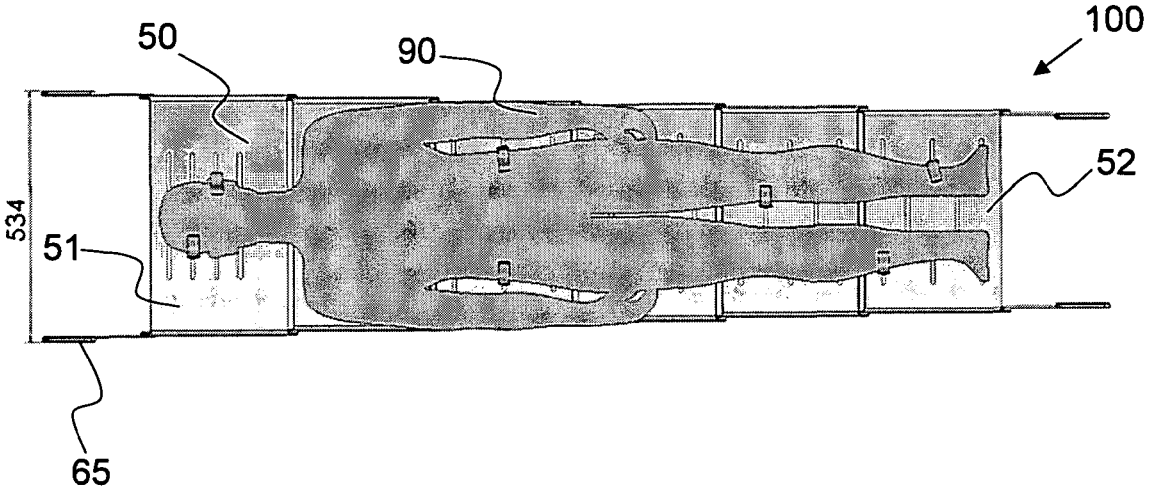
FIG. 3 is a schematic illustration of a foldable stretcher 100 from above.

FIG. 3 schematically illustrates the same embodiment of the foldable stretcher 100 as illustrated in FIG. 1. In this figure, the foldable stretcher 100 illustrated from above. In this figure, it can be clearly seen that the width of the plane members 50 of the stretcher 100 is descending. The plane member 51 in the left terminate of the stretcher 100 is the widest, and plane member 52 in the right terminate of the stretcher 100 the narrowest.

Figure 4:
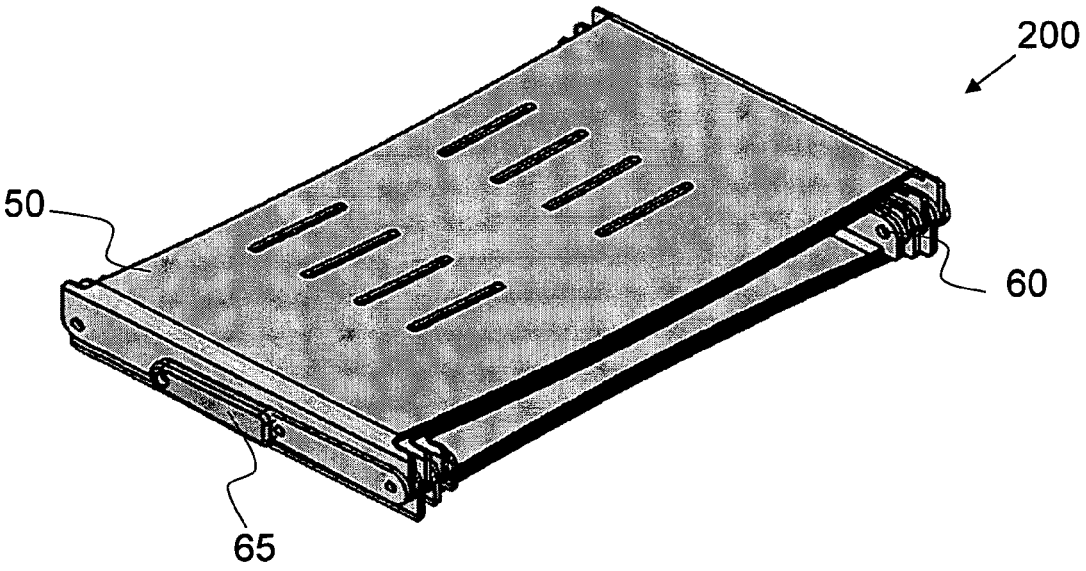
FIG. 4 is a schematic illustration of a foldable stretcher 100 in a folded position.

FIG. 4 schematically illustrates an embodiment of the foldable stretcher 200. The stretcher 200 is in a folded position. The stretcher 200 comprises plane members 50 pivotally connected with each other in series by means of hinges 60. The stretcher 200 is further comprises handles 65 pivotally connected to outermost plane members 50.

Figure 5:
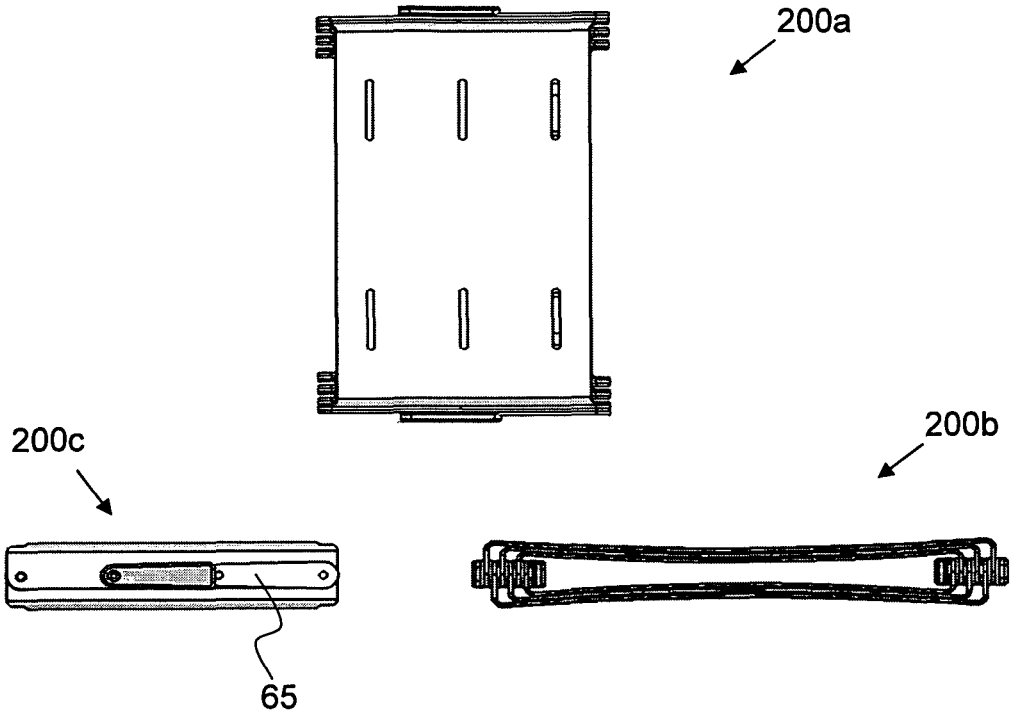
FIG. 5 is a schematic illustration of a foldable stretcher 100 from above and from side view.

FIG. 5 schematically illustrates the same embodiment of the foldable stretcher 200 as illustrated in FIG. 4. In this figure, the foldable stretcher 200*a* is the foldable stretcher 200 illustrated from above. The foldable stretcher 200*b* is the foldable stretcher 200 illustrated from the side of its width. The foldable stretcher 200*c* is the foldable stretcher 200 illustrated from the side of the handles 65.

The invention claimed is:

1. A foldable stretcher for transporting an object; said stretcher comprising a. a plurality of substantially plane members pivotally connected with each other in series by means of hinges therebetween; said plurality of plane members reversibly configurable into an unfolded operative position and a folded transport position;

b. handles pivotally connected to outermost of said plane members;

c. at least two pluralities of props; said props adapted to support said plane members placed on a horizontal surface in said unfolded position; said props are perpendicular to said plane members placed on a horizontal surface in said unfolded position; said each plurality of props is uniformly spaced along a corresponding long side of said stretcher; said each plurality of props pivotally connected to said hinges in an individual manner;

wherein said stretcher further comprises at least two pairs of sufficiently stiff wires; each pair of said wires arranged along a corresponding long side of said stretcher; each said wire is mechanically connected to said stretcher at at least two connection points; said handles adapted for actuating a tautening of at least one of said wires of each pair of wires by fixation of said handles when said stretcher is in said unfolded position; further wherein said tautening of said wires triangularly fixates said hinged props in a supporting position and a first wire and a second wire of said each pair of wires fixates even and odd props, respectively;

further wherein said plane members are characterized by a descending width.

2. The foldable stretcher according to claim 1, adapted in said folded position for transporting on a user's back, storage, in a baggage compartment of a vehicle and any combination thereof.

3. The foldable stretcher according to claim 1, wherein said an object is selected from the group consisting of a patient, an individual of limited capability, an disabled person, an injured person, a victim of emergency, an animal, an unanimated object or any combination thereof.

4. The foldable stretcher according to claim 1, wherein said plane members are made of a material selected from the group consisting of a metal, a polymeric material, a composite material, wood and combination thereof.

5. The foldable stretcher according to claim 1, wherein said plane members are configured into a shape selected from the group consisting of a grate-like shape, a honeycomb-like shape, a perforated shape and any combination thereof.

6. The foldable stretcher according to claim 1, configured for using as a footbridge.

7. The foldable stretcher according to claim 1, configured for using as a bed.

8. The foldable stretcher according to claim 1, configured for fixation of said object to said stretcher by means of tying.

9. The foldable stretcher according to claim 1, comprising materials at least partially transparent to X-rays and electromagnetic fields.

10. A foldable stretcher for transporting an object; said stretcher comprising a. a plurality of substantially plane members pivotally connected with each other in series by means of hinges therebetween; said plurality of plane members reversibly configurable into an unfolded operative position and a folded transport position;

b. handles pivotally connected to outermost of said plane members;

c. at least two pluralities of props; said props adapted to support said plane members placed on a horizontal surface in said unfolded position; said props are perpendicular to said plane members placed on a horizontal surface in said unfolded position; said each plurality of props is uniformly spaced along a corresponding long side of said stretcher; said each plurality of props pivotally connected to said hinges in an individual manner;

wherein said stretcher further comprises two sufficiently stiff wires; each wire is arranged along each corresponding long side of said stretcher; each said wire is mechanically connected to said stretcher at at least two connection points; said handles adapted for actuating a tautening of said wires by fixation of said handles when said stretcher is in said unfolded position; further wherein said tautening of said wires triangularly fixates said hinged props in a supporting position;

further wherein said plane members are characterized by a descending width.

11. The foldable stretcher according to claim 10, adapted in said folded position for transporting on a user's back, storage, in a baggage compartment of a vehicle and any combination thereof.

12. The foldable stretcher according to claim 10, wherein said an object is selected from the group consisting of a patient, an individual of limited capability, an disabled person, an injured person, a victim of emergency, an animal, an unanimated object or any combination thereof.

13. The foldable stretcher according to claim 10, wherein said plane members are made of a material selected from the group consisting of a metal, a polymeric material, a composite material, wood and combination thereof.

14. The foldable stretcher according to claim 10, wherein said plane members are configured into a shape selected from the group consisting of a grate-like shape, a honeycomb-like shape, a perforated shape and any combination thereof.

15. The foldable stretcher according to claim 10, configured for using as a footbridge.

16. The foldable stretcher according to claim 10, configured for using as a bed.

17. The foldable stretcher according to claim 10, configured for fixation of said object to said stretcher by means of tying.

18. The foldable stretcher according to claim 10, comprising materials at least partially transparent to X-rays and electro-magnetic fields.

19. A method of transporting an object, said method comprising the steps of:

(a) providing a foldable stretcher for transporting an object in unfolded position; said stretcher comprising i. a plurality of substantially plane members pivotally connected with each other in series by means of hinges placed therebetween; said plurality of plane members reversibly configurable into an unfolded operative position and a folded transport position, said plane members characterized by a descending width;

ii. handles pivotally connected to outermost of said plane members;

iii. at least two pluralities of props; said props adapted to support said plane members placed on a horizontal surface in said unfolded position; said props are perpendicular to said plane members placed on a horizontal surface in said unfolded position; said each plurality of props is uniformly spaced along a corresponding long side of said stretcher; said each plurality of props pivotally connected to said hinges in an individual manner;

said stretcher further comprises at least one pair of sufficiently stiff wires; each wire is arranged along each corresponding long side of said stretcher; each said wire is mechanically connected to said stretcher at at least two connection points; said handles adapted for actuating a tautening of said wires by fixation of said handles when said stretcher is in said unfolded position; further wherein said tautening of said wires triangularly fixates said hinged props in a supporting position; and a first wire and a second wire of said each pair of wires fixates even and odd props, respectively;

(b) unfolding said stretcher into operative position at said horizontal surface;

(c) placing said object on said stretcher such that said wires of said stretcher are tautened;

(d) transporting said object to a location of interest on said stretcher;

(e) taking down said object from said stretcher; and (f) folding said stretcher wherein said plane members are characterized by a descending width.

* * * * *